US007427923B2

(12) United States Patent
Durand

(10) Patent No.: US 7,427,923 B2
(45) Date of Patent: Sep. 23, 2008

(54) DEVICE FOR DETECTING A BODY FALL INTO A SWIMMING POOL

(75) Inventor: Michel Durand, Nice (FR)

(73) Assignee: M.G. International, La Ciotat (FR)

( * ) Notice: Subject to any disclaimer, the term of this patent is extended or adjusted under 35 U.S.C. 154(b) by 123 days.

(21) Appl. No.: 10/599,733

(22) PCT Filed: Apr. 7, 2005

(86) PCT No.: PCT/FR2005/000848

§ 371 (c)(1),
(2), (4) Date: Oct. 6, 2006

(87) PCT Pub. No.: WO2005/101343

PCT Pub. Date: Oct. 27, 2005

(65) Prior Publication Data

US 2007/0200715 A1 Aug. 30, 2007

(30) Foreign Application Priority Data

Apr. 7, 2004 (FR) ..... 04 03625

(51) Int. Cl.
*G08B 23/00* (2006.01)

(52) U.S. Cl. ..... 340/573.6; 340/614; 73/1.57

(58) Field of Classification Search ..... 340/573.6, 340/614
See application file for complete search history.

(56) References Cited

FOREIGN PATENT DOCUMENTS

| | | | |
|---|---|---|---|
| FR | 2 771 877 | A | 6/1999 |
| FR | 2 797 080 | A | 2/2001 |
| FR | 2 842 933 | A | 1/2004 |
| JP | 06269084 | | 9/1994 |
| WO | WO-02/101678 | A | 12/2002 |

*Primary Examiner*—Jeff Hofsass
*Assistant Examiner*—Hongmin Fan
(74) *Attorney, Agent, or Firm*—Dickstein Shapiro LLP

(57) ABSTRACT

The invention relates to a device enabling an alarm to be triggered in the event of a fall into a swimming pool, and preventing false alarms caused by disturbing elements such as the wind. Said device consists of a probe (1) which is submerged in the liquid used to retransmit the aquatic waves varying in pressure in the compression chamber (8), a piezo-electric-type sensor (2) which is located inside said chamber and used to convert the pressure variations into electrical voltage, another identical sensor (3) located in the housing (7) and enabling the electronic card (4) to substract the two sets of information enabling the vibrations, in addition to the noise caused by the wind on the housing, to be eliminated, and an electronic card (4) which is used to control a siren for alerting the parents. The inventive device can optionally pilot a radio emitter (5) for controlling a deported siren.

8 Claims, 1 Drawing Sheet

DEVICE FOR DETECTING A BODY FALL INTO A SWIMMING POOL

Figure 1:
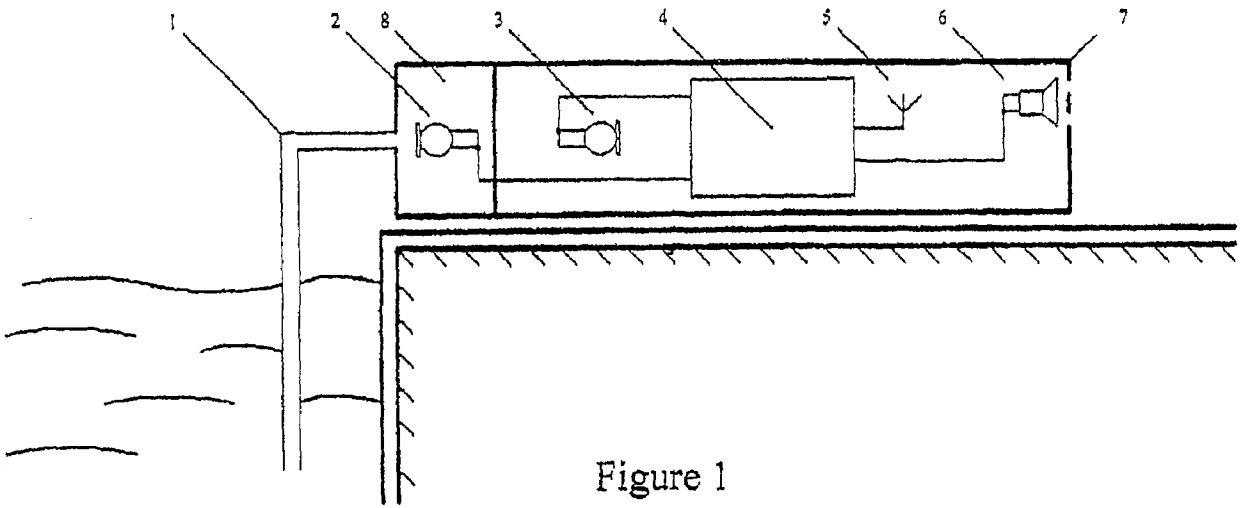

The present invention relates to a device for detecting the fall of a body, in particular that of a child or an animal, into a swimming pool.

Each year many children die by drowning when they fall into a swimming pool which is not being monitored.

The existing means such as physical protection barriers are unsightly and require that the user does not forget to close or lock the gate behind them after each visit or after each use of the swimming pool. The ideal solution for effectively protecting the swimming pool while preserving its appearance would be a device capable of detecting the fall of a body.

Unfortunately it is very difficult to distinguish between the aquatic wave produced by the fall and the disturbing elements such as: the wind on the housing of the device, the waves produced by the wind, the operation of a robot cleaner, the start of filtration, rain, etc.

Moreover, it is not possible to envisage reducing the sensitivity of detection of the device when there is a disturbing element as in certain devices; can the drowning of a child sliding at a 30° slope (little penetration of the water therefore a very weak signal) be accepted on the grounds that force 6 wind gusts were blowing?

The device according to the invention makes it possible to solve these problems, to maintain the maximum sensitivity at all times, while not being prone to accidental triggering caused by the above-mentioned disturbing elements.

To this end the invention proposes a device for detecting the fall of a body into a swimming pool comprising a probe which is submerged in the water of the swimming pool and serves to retransmit aquatic waves varying in pressure in a compression chamber characterized in that it comprises two identical pressure sensors placed respectively in the compression chamber and inside a main housing comprising an electronic card which is able to subtract the signal of the two sensors in order to eliminate the vibrations as well as the noise caused by the wind on the housing.

According to one embodiment, the electronic card is able to control, in the event of detection of a fall, a siren inside the housing.

According to one embodiment, the electronic card is able to control, in the case of detection of a fall, a radio transmitter.

According to one embodiment, the pressure sensors are of the piezoelectric type.

According to one characteristic, the electronic card comprises a band-pass filter centred at one hertz with a narrow bandwidth, the filter being able to reject the signals produced by filtration of the swimming pool, the fall of an object such as a ball, the cleaning of the swimming pool by a robot, rain and by a significant part of the waves produced by the wind.

According to one characteristic, the electronic card comprises a microcontroller which is able to reduce the frequency window of the signals processed by a timer counting the interval separating two signals originating from the pool, the microcontroller rejecting the signals if the period is not within a predetermined interval.

According to one characteristic, the electronic card comprises a microcontroller which is able to count the number of items of valid information.

According to one embodiment, the number of successive and not absent items of valid information for detecting a fall is comprised between 2 and 5.

Figure 2:
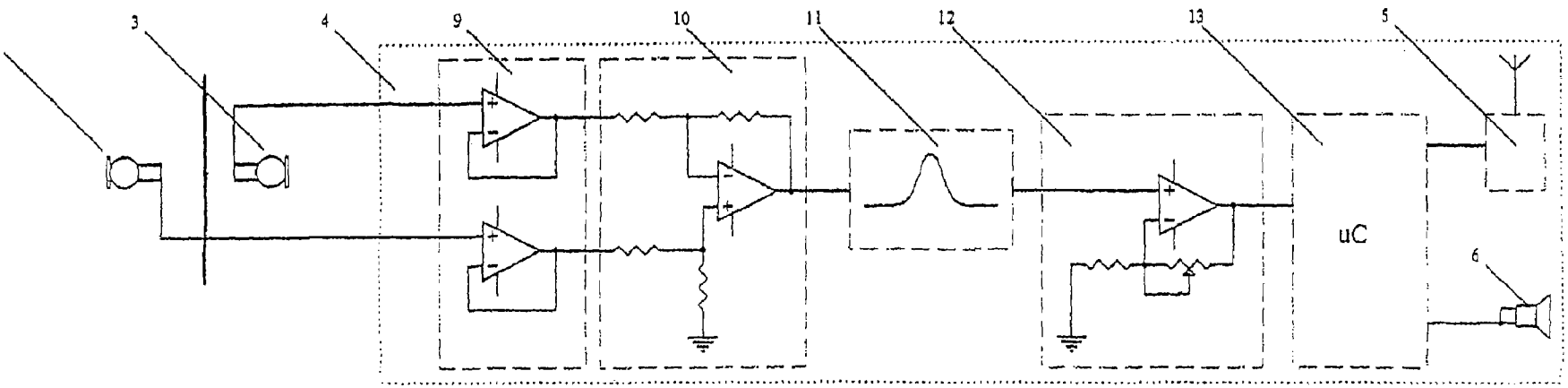

The characteristics and advantages of the present invention will become apparent during the following description given by way of an illustrative and non-limitative example and referring to the figures which show:

FIG. 1, a diagram of a device for detecting a fall according to the invention;

FIG. 2, a diagram of the electronic card of the device according to the invention.

FIG. 1 diagrammatically represents the embodiment of the device according to the invention.

The detection device is composed of a housing (7) protecting the electronics (4) which is above the water, a probe constituted by a plastic tube which is submerged in the water of the swimming pool (1) serving to retransmit the aquatic waves varying in pressure in the first part of the above-water housing (8) serving as a compression chamber.

The pressure variations are converted into a voltage by the piezoelectric type sensor (2).

Another similar sensor (3) situated in the main compartment of the housing allows, by subtraction on the electronic card (4), the elimination of the vibrations as well as the noise caused by the wind on the housing (7).

This principle of two identical sensors mounted differentially makes it possible to overcome problems caused by the wind on the housing because each sensor of the pair detects the same vibration, a simple subtraction makes it possible to detect only the pressure difference inside the compression chamber (8).

As regards the working frequency of the device, the location and the direction of the two sensors (2) and (3) is not critical, in fact, the sensor (2) can be mounted across the partition separating the compression chamber (8) and the main compartment.

The electronic card (4) described later controls a siren (6) integrated in the housing (7). In addition, the card optionally controls a radio transmitter (5) serving to control a remote siren.

FIG. 2 diagrammatically represents the electronic card (4) as well as the various elements from which it is composed.

The two sensors (2) and (3) are connected to two impedance converters (9) allowing a very high input impedance to be obtained at the sensors, in addition their very low output impedance makes it possible to drive a subtracter also called a differential amplifier (10).

This subtracter makes it possible to distinguish between the disturbances on the housing which enter together and the pressure differences in the compression chamber produced by the aquatic waves.

The output of the subtracter (10) drives a band-pass filter (11), this filter is centred at one hertz with a very narrow bandwidth.

This makes it possible to detect only the signature of a fall into the swimming pool which is situated close to one hertz, to reject the filtration, the fall of a ball, the cleaning of the swimming pool by a robot, rain and to eliminate some of the waves produced by the wind, to at least greatly diminish the noise caused by the wind inside the swimming pool and thus to avoid saturation of the signal to be analyzed.

The wind in the swimming pool produces an almost "white" noise covering a wide range of frequencies and with very high amplitude relative to the signature of the fall.

Moreover, the band-pass filter (11) having a very narrow band of operation has a very high quality "Q" factor, this makes it possible to always obtain at its output a signal of the sinusoidal type in the hertz frequency band.

This makes it possible to format the signal to be analyzed even if the latter is deformed by a pool churned up by the wind, the signature of the fall is always clean.

The output of the filter (11) passes into an adjustable gain amplifier (12), this can be adjusted so as to be able to best adapt to the pool to be protected, as a function of: the dimensions, the depth, the immersion depth of the probe (1), the distribution of electronic components and sensors.

This amplifier serves to obtain a sufficiently large signal between 1 and 2 volts in order that it can be easily interpreted by the microcontroller (13).

In order to obtain a reliable triggering in the case of a fall and no triggering in the case of a disturbing element, two processings are carried out inside the microcontroller (13).

First processing: further reducing the frequency window already reduced by the filter (11).

In order to do this: a timer counts the time interval separating two signals, if the period is too long or not long enough, the software rejects the information and considers that it may be caused by the wind on the pool.

Second processing: as the wind passes into our frequency capture area (since it produces white noise) the number of items of valid information obtained are counted.

In fact, a difference still remains between the wind and the signature of the fall: the fall is a cyclic wave which is repeated over time, as regards the wind it is a chaotic noise which sweeps over a whole frequency band, it is not constant either in frequency or amplitude.

The fact of counting a successive number of items of valid information makes it possible to reliably differentiate between the fall and the wind.

The valid information must be successive and not missing, the number of items of valid information can vary from two to five.

From experience it is known that three consecutive items of valid information is a good compromise between the speed of reaction and good immunity to the waves caused by the wind on the pool.

For example, a counting of three valid items of information only delays the triggering of the alarm by approximately three seconds, if the distance between the fall and the alarm detector is 7 meters (approximately 7 seconds, the time for the aquatic wave to arrive at the probe) then 3 seconds of processing remain, the alarm is triggered in less than 11 seconds which is still entirely acceptable.

It is thus possible to avoid accidental triggerings with a force 6 wind while still having the maximum sensitivity to detect the fall of a 6-month old child measuring 65 cm and weighing 6.5 kg at a 30% slope.

The microcontroller (13) controls a siren (6) integrated into the housing serving to alert the parents.

It can optionally also control a radio transmitter (5) for controlling a remote siren.

Adjustments can be made to the description which has just been given without exceeding the scope of the invention. Thus, the amplifier (12) could be placed between the subtracter (10) and the filter (11), this works just as well.

Moreover, the microcontroller (13) could be replaced by a pair of fixed-threshold comparators followed by an oscillator counter.

The invention claimed is:

1. Device for detecting a body fall into a swimming pool, the device comprising a main housing, a compression chamber and a probe, the probe being submerged in the water of the swimming pool and serves to retransmit aquatic waves varying in pressure in the compression chamber, wherein the device further comprises two identical pressure sensors of the same type placed respectively in the compression chamber and inside the main housing, wherein the main housing includes an electronic card which is able to calculate the differential signal between the two sensors in order to eliminate the vibrations as well as the noise caused by the wind on the housing.

2. Detection device according to claim 1, wherein the electronic card is able to control, in the event of detection of a fall, a siren inside the housing.

3. Detection device according to claim 1, wherein the electronic card is able to control, in the event of detection of a fall, a radio transmitter.

4. Detection device according to claim 1, 2 or 3, characterized wherein the pressure sensors are of the piezoelectric type.

5. Detection device according to claim 1, 2 or 3 wherein the electronic card comprises a band-pass filter centred at one hertz with a narrow bandwidth, the filter being able to reject the signals produced by the filtration of the swimming pool, the fall of an object such as a ball, the cleaning of the swimming pool by a robot, rain and by a significant part of the waves produced by the wind.

6. Detection device according to claim 1, 2 or 3 wherein the electronic card comprises a microcontroller which is able to reduce the frequency window of the signals processed by a timer counting the interval separating two signals originating from the pool, the microcontroller rejecting the signals if the period is not within a predetermined interval.

7. Detection device according to claim 1, 2 or 3 wherein the electronic card comprises a microcontroller which is able to count the number of items of valid information.

8. Detection device according to claim 7, wherein the number of successive and not missing items of valid information for detecting a fall is comprised between 2 and 5.

* * * * *